US006415779B1

(12) United States Patent
Colomby

(10) Patent No.: US 6,415,779 B1
(45) Date of Patent: Jul. 9, 2002

(54) METHOD AND DEVICE FOR FAST AUTOMATIC ADAPTATION OF RICHNESS FOR INTERNAL COMBUSTION ENGINE

(75) Inventor: Marcel Colomby, Argenteuil (FR)

(73) Assignee: Magneti Marelli France (FR)

( * ) Notice: Subject to any disclaimer, the term of this patent is extended or adjusted under 35 U.S.C. 154(b) by 0 days.

(21) Appl. No.: 09/622,963

(22) PCT Filed: Feb. 22, 1999

(86) PCT No.: PCT/FR99/00390

§ 371 (c)(1),
(2), (4) Date: Oct. 17, 2000

(87) PCT Pub. No.: WO99/43939

PCT Pub. Date: Sep. 2, 1999

(30) Foreign Application Priority Data

Feb. 25, 1998 (FR) ..... 98 02273

(51) Int. Cl.[7] ..... F02D 41/14

(52) U.S. Cl. ..... 123/674; 701/109

(58) Field of Search ..... 123/674, 675; 701/109

(56) References Cited

U.S. PATENT DOCUMENTS

| | | | | |
|---|---|---|---|---|
| 4,593,666 A | | 6/1986 | Lefevre et al. | 123/480 |
| 5,293,852 A | * | 3/1994 | Lehner et al. | 123/339 |
| 5,638,802 A | * | 6/1997 | Maki et al. | 123/675 |

FOREIGN PATENT DOCUMENTS

| | | |
|---|---|---|
| EP | 0 637 685 | 2/1995 |
| FR | 2 708 047 | 7/1993 |

* cited by examiner

*Primary Examiner*—Andrew M. Dolinar
*Assistant Examiner*—Johnny H. Hoang
(74) *Attorney, Agent, or Firm*—Piper Rudnick

(57) ABSTRACT

The invention concerns a method for automatic adaptation of an injection engine by a computer connected to sensors. The sensors supply an engine filling parameter. An oxygen probe in the exhaust gases, defines, at each adapting cycle, a new line of control magnitude based on the filling parameter and using new coefficients computed from coordinates of two points. Corresponding corrected values of the control magnitude from a working line are filtered and stored during a preceding cycle. One of the two points is acquired previously, and then in adopting a new working line, an intermediate line between the new line and the previous working line is used. The invention is applicable to injection engine control.

18 Claims, 3 Drawing Sheets

METHOD AND DEVICE FOR FAST AUTOMATIC ADAPTATION OF RICHNESS FOR INTERNAL COMBUSTION ENGINE

TECHNICAL FIELD

The invention relates to a method and a device for fast automatic adaptation of air/fuel ratio for a fuel-injection engine, i.e. an internal combustion engine of the controlled ignition type fitted with a fuel-injection system, and having an oxygen sensor, commonly referred to as a λ sensor, which detects the oxygen content of the exhaust gases.

The invention therefore relates to fuel-injection engines, in particular for motor vehicles, and a method of automatically adapting the control characteristics governing the fuel supply, i.e. a system of automatically adapting parameters governing charging of the engine cylinders, and which offers an improvement on the automatic adaptation method known from FR-A-2 708 047. The method of rapid automatic adaptation proposed by the invention may simultaneously also be a method of purging a circuit having a canister associated with the engine.

The invention also relates to an automatic adaptation device for implementing the improved method proposed by the invention and incorporates a computer, which computer at least controls the injection system but is preferably an engine control computer which additionally controls at least the ignition process.

BACKGROUND

It is common knowledge that, for a given type of engine, an adapted engine control parameter or variable, such as the quantity of fuel injected or the injection duration, given that the fuel flow rate-injection duration characteristic of the injectors is known, and which is referred to as a control variable throughout this description, is a known characteristic function which depends on parameters representative of the charging of each of the engine cylinders, referred to as charging parameters throughout this description, and such as the absolute pressure at the air intake manifold, the flow rate of the air admitted to the engine or alternatively the angle at which a throttle valve opens in a valve body on the air intake pipe to the engine, in combination with the speed or rotation speed of the engine. In particular, it is known that the basic fuel injection duration, from which the injection duration effectively applied to the injectors is obtained, is defined as a function of the absolute pressure in the air intake pipe to the engine by means of a characteristic curve which can be likened, in a steady state and across the greater part of the operating range of the engine, to a straight-line curve with a slope G, known as gain, and an initial abscissa D, referred to as shift, for a given engine speed. The increasing linear relationship between the basic injection duration TinjB and the absolute intake pressure P can therefore be written as follows:

$$TinjB=(P-D)\times G, \quad (1)$$

where the intake pressure P represents the torque required from the engine, or load, at a given speed.

A known approach to controlling engine operation at an air/fuel ratio of around 1, corresponding to the stoichiometric mixture, is to determine an air/fuel ratio coefficient KO2 which is used to correct the basic injection duration TinjB. This air/fuel ratio coefficient KO2 is derived from a servo-loop monitoring the air/fuel ratio R of the air-fuel mixture from an oxygen sensor positioned in the flow of the engine exhaust gas. In practice, the air/fuel ratio coefficient KO2 is between 0.75 and 1.25 and constitutes a multiplicative correction factor for the basic injection duration TinjB, which is therefore corrected by acting on KO2 to an air/fuel ratio R equal to 1. Acting on KO2 generally consists in applying value transitions to this coefficient on either side of a mean value, generally set at 1, for operating the engine in open loop.

Simultaneously, another known approach is to adapt the coefficients D and G automatically as a means of keeping the air/fuel ratio coefficient KO2 as close to its mean value as possible.

Due in particular to manufacturing tolerances, wear and/or the need to replace engine parts or components, the engines exhibit quite different characteristics from one engine to another. However, in order to ensure that engines continue to operate satisfactorily, there is a constant striving towards simultaneously obtaining an air/fuel ratio signal R and an air/fuel ratio coefficient KO2 equal to 1 whilst automatically compensating for tolerances and drifts in engine characteristics by automatically adapting the coefficients D and G of the straight-line curve representing the operation of each engine.

A method of this type for automatically adapting the air/fuel ratio of an injection engine is known from FR-A-2 708 047 and uses a computer which, on the one hand, is connected at least to sensors monitoring engine operating parameters, from which the computer receives at least one engine speed signal and a signal enabling an engine charging parameter P to be determined, this being the absolute pressure in an air intake pipe to the engine downstream of a throttle member such as a butterfly valve controlling the air supply rate, and to an oxygen sensor in the engine exhaust gas, from which the computer receives an air/fuel ratio signal R, and, on the other hand, computes at least values of at least one control variable, namely injection durations to be transmitted to at least one injector, which are obtained from basic values for the control variable TinjB expressed as increasing linear functions of the charging parameter P and represented by straight-line curves, each defined by two coefficients, these being a shift D of the initial charging parameter and a gain G indicating the slope of the line such that TinjB=(P−D)×G, each basic value of the control variable TinjB being corrected to generate a corrected value for said control variable TinjCOR taking account of an air/fuel ratio coefficient KO2, to which value transitions are applied as a function of the air/fuel ratio signal R in the operating zones of the engine in closed loop, and fixed at a mean value in the operating zones of the engine in open loop in order to ensure that engine operation is centred an air/fuel ratio R equal to 1, the shift D and the gain G also being automatically adapted in cycles to ensure that the air/fuel ratio coefficient KO2 remains close to its mean value, by correction of any shift of this coefficient KO2 in taking account of the top and bottom values Ph and Pb of the charging parameter for operating points of the engine in a stabilized state.

The teaching of the above-mentioned document is based in particular, for a stabilized engine and depending on certain previous operating conditions of the engine, on enabling the air/fuel ratio to be automatically adapted by modifying at least the shift D and preferably only the shift, within a first operating range of the engine, at low intake pressure (for low charging parameter values) and by modifying at least the gain G and preferably only the gain within a second operating range of the engine, at high intake pressure (for high charging parameter values), these pressure ranges being set.

The disadvantage of this automatic adaptation system is that it is difficult to operate in practice due to the fact that the frequency at which the high-pressure operating range occurs, in the order of 70 kPa, and hence the opportunity of being able to take real and multiple measurements of engine operating parameters during service, is low within a standard cycle when driving a motor vehicle fitted with this engine in the city.

Furthermore, according to the above-mentioned document, whenever an automatic adaptation phase is initiated, it is allowed to continue for a maximum number of n1 cycles at most within the first operating range and for a maximum number of n2 cycles at most within the second operating range and a new automatic adaptation of shift D or gain G is not permitted until after all the automatic adaptation cycles permissible in gain and shift have been performed. The fact that the engine does not operate often enough at the high-pressure range but all the automatic adaptation cycles at high pressure nevertheless have to be run before reverting to automatic adaptation at low pressure means that the engine is not automatically adapted to gain and shift efficiently. This known method therefore has the disadvantage of being too slow in terms of its automatic adaptation function.

The problem underlying the invention is to remedy the disadvantage outlined above and to propose an improved method of automatic adaptation designed to determine dynamically the operating characteristic or line of the engine in its linear section, allowing the gain G and shift D to be computed simultaneously, these being the coefficients relating to the engine charging line.

Another objective of the invention is to propose an improved method of automatic adaptation which will advantageously enable controlled purging of a canister purging circuit associated with the engine, in a manner also known from FR-A-2 708 047, in which it is prohibited to simultaneously have an automatic adaptation phase and a flow rate of a bleed valve of the purging circuit.

SUMMARY OF THE INVENTION

To this end, the method proposed by the invention is characterized in that it comprises steps which, for each new cycle of automatic adaptation of the order n, consist in defining a new characteristic line for the control variable Tinj as a function of the charging parameter P on the basis of new coefficients Dnew and Gnew, computed from the charging parameter and control variable coordinates at two points, one of which is at a top value Ph and the other at a bottom value Pb of the charging parameter, and to which corrected values for the control variable TinjCORh and TinjCORb correspond, by applying the formulas:

$$Gnew = \frac{TinjCORh - TinjCORb}{Ph - Pb} \text{ and}$$

$$Dnew = Pb - \frac{TinjCORb}{Gnew}, \text{ and}$$

validating a value Pk,n, measured when the engine is in a steady state, as a top value Ph,n or respectively as a bottom value Pb,n for the charging parameter, correlating to it a basic value respectively for the top or bottom control variable, in the order n, TinjBk,n taken from an operating line filtered and stored in the computer during the preceding cycle n−1 and defined by the stored coefficients DFil,n−1 and GFil,n−1, and then correlating it to a corrected value for the control variable TinjCORk,n in order to obtain a first point, and taking as the second point respectively the point having the top or bottom value for the charging parameter from the two points stored in the computer during the preceding cycle n−1, and having coordinates Pb,n−1, TinjCORb,n−1; Ph,n−1, TinjCORh,n−1, and then adopting as the new filtered operating line, defined by new filtered coefficients DFil,n and GFil,n, an intermediate line between the stored line having coefficients DFil,n−1 and GFil,n−1 and the new line defined by the newly computed coefficients Dnew and Gnew, and storing the new filtered coefficients GFil,n and DFil,n and substituting them for the preceding filtered coefficients GFil,n−1 and DFil,n−1 to determine the next operating line for the next automatic adaptation cycle.

Accordingly, each new operating line of the engine is defined by its new filtered coefficients GFil,n and DFil,n computed on the basis of the coordinates (charging parameter and corrected control variable needed to obtain stoichiometric air/fuel ratio) of two operating points captured during stable operating phases of the engine, and one of which, having coordinates (Pb,n−1, TinjCORb,n−1) or, as is the case, (Ph,n−1, TinjCORh,n−1), is known and located on the preceding filtered operating line, having coefficients DFil, n−1 and GFil,n−1, stored during the preceding cycle n−1 following the last acquisition process, whilst the other point corresponds to a real value of the charging parameter Pk,n measured and validated at a stabilized speed, and a value of the control variable TinjBk,n taken from said preceding filtered operating line, then replaced by a corrected value TinjCORk,n to take account of the value of KO2 acquired simultaneously, the new filtered operating line, having filtered coefficients DFil,n and GFil.n, being part-way between the filtered operating line of the preceding cycle and the new line computed directly from the coordinates of the two operating points thus defined. The values for the new filtered coefficients GFil,n and DFil,n replace the preceding coefficients GFil,n−1 and DFil,n−1 in memory and the coordinates for the newly acquired point (Pk,n, TinjCORk,n) are also stored and become the coordinates for one of the two points for the next cycle of measurements.

Consequently, a recentering of the "first order" is obtained very rapidly by modifying the adaptation terms, being the shift D and the gain G, because:

- it is much easier to fulfil the adaptation conditions by suppressing specific ranges of the charging parameter in order to adapt the shift D and the gain G, and
- the gain G and the shift D are computed simultaneously and instantaneously so that the adaptation speed is no longer limited by the convergence constraint which imposed very slow variations in the adaptation terms applied using the method known from the aforementioned document.

Advantageously, when the engine is running at a stabilized speed, the method also consists in validating the measured value of the charging parameter Pk,n as the new top Ph,n or bottom Pb,n value respectively only if Pk,n is respectively above a suppressed adaptation band of a predetermined width and having the point with the bottom value stored during the preceding cycle (Pb,n−1) as a lower limit, or below said suppressed adaptation band and having the point with the top value stored during the preceding cycle (Ph,n−1) as an upper limit. Consequently, a minimum distance between the two points adopted, which is necessary if the computation is to be accurate, defines the permitted adaptation zones. The condition used to validate the value of the newly acquired charging parameter (Pk,n) is that this value is outside the suppressed adaptation band AP, the width of which is predetermined.

Furthermore, with each new cycle of automatic adaptation of order n, the method additionally consists in making a new suppressed adaptation band contiguous with the value entered for the charging parameter Pk,n and comparing this latter value with the lower limit Pb,n−1 of the previous suppressed adaptation band so that if Pk,n is lower than Pb,n−1, Pk,n will then become the new lower limit Pb,n and the new upper limit will become: Ph,n=Pk,n+ΔP, ΔP being the width of the suppressed adaptation band, and if Pk,n is higher than Pb,n−1, Pk,n will then become the new upper limit Ph,n and the new lower limit becomes: Pb,n=Pk,n−ΔP. Accordingly, during a cycle, depending on whether Pk is found to be above or below the suppressed adaptation band stored in memory, Pk will become the new top point Ph or the new bottom point Pb respectively, which determines the upper or lower limit respectively of the new adaptation band that will be suppressed ΔP.

Furthermore, in order to limit errors in the shift computation, it is necessary to impose a maximum value on the bottom value of the charging parameter, which means that the method will also consist in validating the measured value of this parameter Pk,n as a new bottom value Pb,n only if, in addition, Pk,n is below or equal to a value threshold of the charging parameter, for example in the order of 50 kPa, in calibration, if this charging parameter is the absolute pressure in the air intake pipe, downstream of the throttle member.

In accordance with this method, the engine speed is deemed to have stabilized if, after a predetermined number of transitions in the air/fuel ratio coefficient KO2 around its mean value and if the engine speed N and the position of said throttle member are substantially constant, the difference between the measured value of the charging parameter Pk,n and a measured and filtered value of this parameter PkFil,n is below a value threshold, in which PkFil,n=PkFil,n−1+k (Pk,n−PkFil,n−1), and where k is a factor between 0 and 1. This being the case, a cycle of measurements and computations to find the coefficients of the new filtered operating line DFil,n and GFil,n is initiated if the measured and filtered value PkFil,n of the charging parameter falls outside the suppressed adaptation band located in the preceding cycle N−1 and Pk is replaced by PkFil in the aforementioned formulas in order to meet said conditions.

Consequently, in accordance with the invention, the coefficients of the engine operating line are stored in the computer and then constantly updated when the engine is operating, during repetitive measuring cycles initiated whenever the engine enters a phase of stabilized operating speed, at a charging parameter value which is outside the suppressed band. The new coefficients resulting from the current measurements take the place of the preceding ones in the memory of the computer.

In accordance with one advantageous embodiment of the invention, an iterative correction of the coefficients defining the engine characteristic is applied more or less progressively in accordance with a logical filtering algorithm in order to avoid too abrupt variations in the operating parameters as they are updated and so as to move progressively towards a mean characteristic. To this end, the method also consists in defining the new filtered operating line, having coefficients DFil,n and GFil,n, by applying a logical filtering process to the new computed coefficients Dnew and Gnew which consists in taking into account only a fraction of the difference between Dnew and Gnew respectively and the preceding filtered coefficients DFil,n−1 and DFil,n−1 respectively using an approximation of the first order, on the basis of adaptation correction factors KD and KG, which range between 0 and 1 and may be equal, such that:

$$DFil,n=DFil,n-1+KD(Dnew-DFil,n-1)$$

and $$GFil,n=GFil,n-1+KG(Gnew-GFil,n-1).$$

The filtering rate applied may comprise several levels depending on the adaptation rate of the engine, on the basis of the values assumed by the air/fuel ratio coefficient KO2 and picked up in particular in each of the top and bottom adaptation ranges, i.e. outside the suppressed adaptation band.

To this end, the method also consists in applying adaptation correction factors KD and KG at several levels, depending on the control rate of the engine translated by the value of the air/fuel ratio coefficient KO2, the level of the factors KD and KG being selected depending on the value of KO2 as ascertained in each of the ranges of the top and bottom values of the charging parameter respectively above and below the corresponding suppressed adaptation band.

In a preferred embodiment, a strong, mean or weak value is chosen respectively for at least one of the factors KD and KG depending on whether the air/fuel ratio coefficient KO2 is measured outside a band of the air/fuel ratio coefficient centred on the mean value of KO2 and of predetermined width, in the two charging parameter ranges above and below said suppressed adaptation band, or measured outside said air/fuel ratio coefficient band in one of said charging parameter ranges above or below said suppressed adaptation band but inside said air/fuel ratio coefficient band in the other of said upper and lower charging parameter ranges and, finally, measured inside said air/fuel ratio coefficient band in the two upper and lower charging parameter ranges.

If the computer is switched off, which in practice is when the engine is switched off, the computer memory specifically saves the last coefficients DFil and GFil stored, which will define the initial operating line of the engine next time the computer is switched on, which in practice is when the engine is next started. A specific initialisation system allows typical coefficients to be loaded whenever the computer is switched back on.

To this end, every time the engine is started, the method also advantageously consists in determining, by means of the filtered operating line, having coefficients DFil and Gfil, stored in memory on re-starting, two theoretical values for the control variable TinjCORh and TinjCORb corresponding to two values of the charging parameter selected from outside the usual range of values for said charging parameter and which are a top initialisation value PhINIT and a bottom initialisation value PbINIT respectively, selecting a suppressed adaptation band essentially centred between PbINIT and PhINIT, with a lower limit Pb higher than PbINIT and an upper limit Ph lower than PhINIT, after which the measuring and computing cycle is then run as in the continuous state, a new validated value being acquired for the charging parameter if said new value falls outside the suppressed adaptation band and the coefficients DFil,n and GFil,n for the new filtered operating line being computed on the basis of the new measured and filtered value of the charging parameter PkFil and one of the two initialisation value points PhINIT or PbINIT of said parameter. During the measuring and computing cycle following a re-start of the engine, the filtered value of the air/fuel ratio coefficient KO2 is also regarded as its mean value, i.e. 1 if KO2 is a multiplicative factor for correcting the basic values to generate corrected values of the control variable. Furthermore, when the engine is re-started, it is of advantage if the computer is adapted progressively to the real conditions by setting the initial values for the adaptation correction factors KD and KG as a function of a fictitious degree of engine adaptation, for example assuming that KO2 is inside said air/fuel ratio factor band for each of the top and bottom bands of the charging parameter which are respectively above and below the suppressed adaptation band.

Furthermore, before the computer is switched on for the first time, the method also consists in pre-loading initial values GINIT and DINIT of the operating line coefficients into the computer memory, which are defined experimentally for the specific type of engine and substituting them for the coefficients GFil and DFil stored for start-up purposes and not yet existing.

If the engine co-operates with a purging circuit, fitted with a canister to collect fuel vapours from at least one tank and connected to the engine intake pipe by an electrically controlled valve for purging the canister, and whose rate is driven by the computer so that the simultaneous timing of the purging valve and of the automatic adaptation system is prohibited, as disclosed in FR-A-2 708 047, it is of advantage to provide additional steps in the method proposed by the invention so as to supplement it, associating the automatic adaptation strategy with a strategy for purging the canister, priority being assigned to one or the other of the two strategies depending on the engine adaptation level and the degree to which the canister is filled. If the canister is very full of fuel vapours, the automatic adaptation will be inhibited. In the reverse situation and if the engine is not being sufficiently adapted in a top or bottom range of the charging parameter, i.e. if KO2 is not within said air/fuel ratio coefficient band in this top or bottom range, adaptation will take priority in this specific range of the charging parameter. The priority between adaptation and purging the canister is managed by modulating the width of the suppressed adaptation band. This suppressed adaptation band is fully reserved for the canister purging, and the wider this suppressed band, the more the canister purging has priority. In accordance with the method, it is therefore sufficient to modulate this width relative to a nominal value of the suppressed adaptation band in order to manage the priority between adaptation and purging the canister.

To this end, the method also consists in widening the suppressed adaptation band respectively towards the top values or towards the bottom values of the charging parameter if the engine regulation rate is satisfactory, depending on the value of the air/fuel ratio coefficient KO2, within the respective top or bottom range of the charging parameter which is above or below said suppressed adaptation band respectively before it is widened.

However, in order to reactivate the adaptation options, the method advantageously also consists in making the widening of the suppressed adaptation band effective only during a predetermined period of time, assisted by a counter which is re-started with each automatic adaptation cycle to count down said period of time. Furthermore, so as to take account of how full the canister is, the method may also consist in defining an estimated coefficient KCAN of the fuel contents in the purging circuit, in the manner described in FR-A-2 708 049, to which reference may be made for further information and advantages on this subject. All that will be said here is that this coefficient KCAN may be worked out when purging is permitted on the basis of the deviation of the air/fuel ratio coefficient KO2 so that KCAN is increased or decreased respectively if KO2 is respectively below or above its mean value. The method therefore consists in entering an automatic adaptation phase if KCAN falls below a predetermined threshold relating to the fuel content.

Another objective of the invention is a device for automatically adapting the air/fuel ratio of an injection engine, comprising a computer connected to sensors detecting operating parameters of the engine as well as an oxygen sensor in the exhaust gas of the engine, said computer computing values of a control variable such as the injection duration applied to at least one fuel injector of the engine, and obtained from base values TinjB expressed as increasing linear functions of a charging parameter of the engine, such as the pressure P in an air intake pipe of the engine, with a shift D from the original charging parameter and a gain G corresponding to the slope of the corresponding characteristic line, said base values TinjB of the control variable being corrected by means of an air/fuel ratio coefficient KO2 determined by the computer as a function of the air/fuel ratio signal R from the oxygen sensor operating in a closed loop and equal to a mean value when operating in an open loop, in order to centre the engine operation on an air/fuel ratio equal to 1, the computer automatically adapting the shift D and the gain G in cycles to ensure that KO2 remains close to its mean value by correcting any deviation in KO2 and which is characterized in that the computer comprises at least one microprocessor programmed and/or set up so as to control running of the method proposed by the invention as described above.

Other advantages and features of the invention will become clear from the following description of an example of an embodiment, which is not restrictive in any respect, and with reference to the drawings, of which:

DETAILED DESCRIPTION OF THE PREFERRED EMBODIMENT

Figure 1:
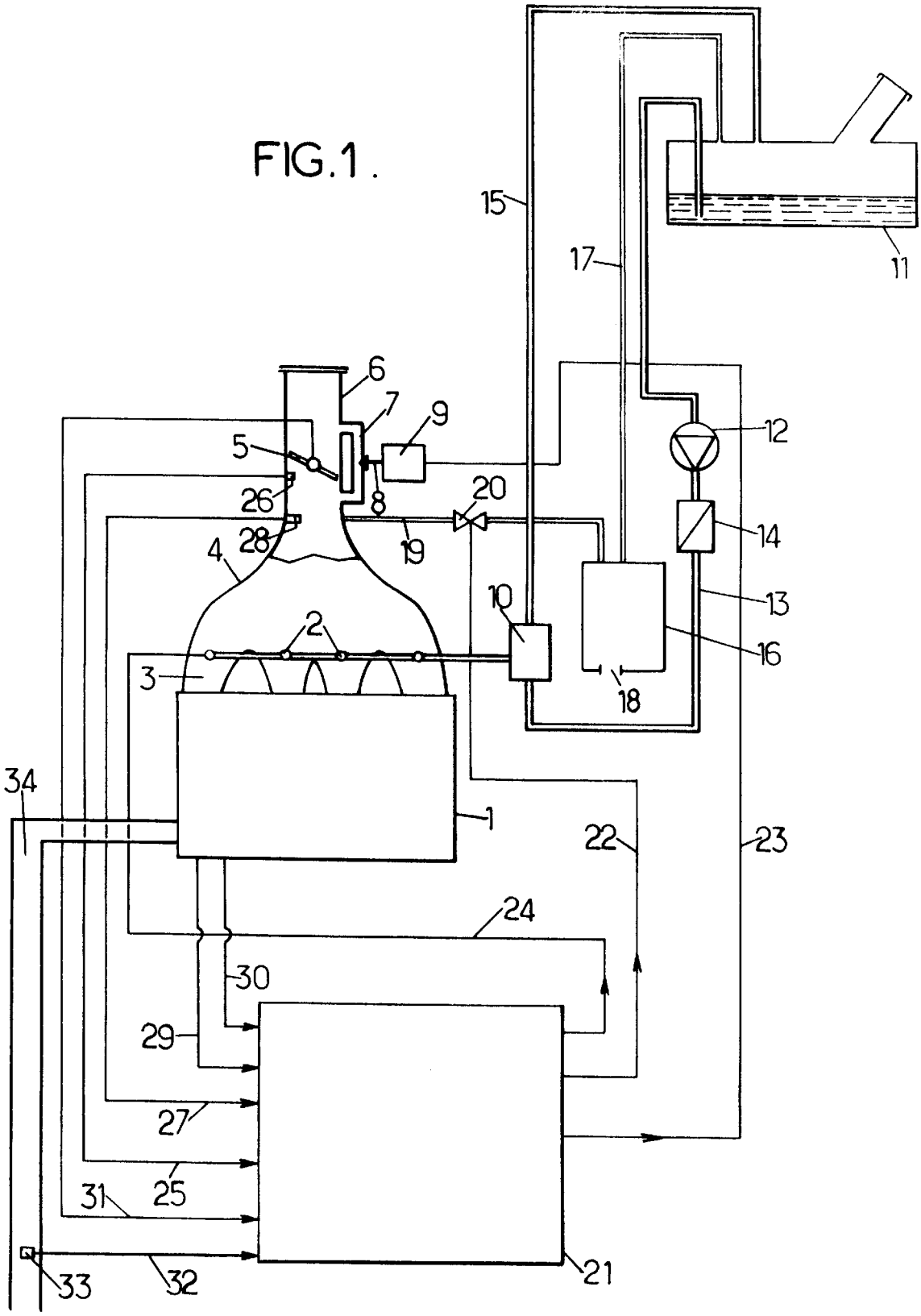
FIG. 1 is a schematic illustration of an injection engine with a purging circuit with a canister, a control computer and a λ sensor.

FIG. 1 provides a schematic illustration of a four stroke-four cylinder and controlled ignition engine, shown generally by reference 1, fitted with an injection system, of the multipoint type, for example. This system comprises four injectors 2 each mounted in one of the four respective branches 3 downstream of an intake pipe 4, and each opening into the cylinder head of the engine 1 on a level with the intake valve(s) of a corresponding cylinder. A throttle valve 5 for controlling the air intake rate is rotatably mounted in a throttle member 6 in the upstream part of the pipe 4, the throttle member 6 having a bypass duct 7 on the throttle 5, the passage section of which is regulated by a valve shown by reference 8 and controlled by a stepper motor 9, for example.

The injectors 2 are supplied with fuel at a pressure defined by a regulator 10, which is in turn supplied from a tank 11, closed by a tight plug, by means of a pump 12 on a supply passage 13 on which a filter 14 is also mounted. The complement of the fuel quantity diverted by the regulator 10 to the injectors 2 is returned to the tank 11 via a return passage 15.

The fuel vapours forming in the tank 11 in particular are collected by a canister 16, containing an absorbent charge for these vapours, activated carbon for example, and connected to the tank via a recovery line 17. The canister 16 has a vent 18 by means of which the tank is vented to the open air and the canister 16 is connected to the intake pipe 4 downstream of the throttle valve 5 via a suction line 19 on which an electrically controlled valve 20 is mounted for purging the canister 16 when a command is issued to the valve 20 to open. This valve 20 is a solenoid valve normally closed in the non-operating position and when open is controlled by a variable cyclical opening ratio (C.O.R).

The variable C.O.R. of this valve 20 and hence the rate at which the canister 16 is purged of the fuel vapours it contains, as well as the position of the electric stepper motor 9 are piloted by electric commands transmitted to the valve 20 and the stepper motor 9 from a computer 21 via conductors 22 and 23. Similarly, the opening duration or injection duration of the injectors 2, on which the quantity of fuel injected by each injector 2 into the corresponding cylinder depends (since the difference in fuel pressure applied to the injectors 2 is constant and fixed by the regulator 10), is driven by electric commands applied by the computer 21 to the injectors 2 via a conductor 24.

These electric commands (injection duration, variable C.O.R., command to the stepper motor) are worked out by the computer 21 on the basis of signals received from different sensors picking up engine operating parameters, including a signal denoting the temperature of the intake air 25 transmitted by a temperature sensor 26 positioned in the vein of air, a signal indicating the absolute air intake pressure 27 transmitted by a pressure sensor 28 in the pipe 4, a temperature signal 29 for the coolant water of the engine 1, supplied by a sensor which is not illustrated, and an engine speed signal 30, which enables the engine speed N to be determined as well as the engine phases of the different cylinders used to determine the injection timing as well as ignition if the computer 21 is an engine control computer.

The computer 21 also receives at 32 a signal 31 indicating the opening angle of the throttle 5 supplied by an appropriate sensor such as a potentiometer, which duplicates the angular position of the throttle 5, and is mounted on the rotation axis thereof.

The computer 21 also receives at 32 an air/fuel ratio signal R supplied, in the form of electric voltage, by an oxygen sensor 33 known as a k sensor, arranged in the exhaust gas 34 of the engine 1, which indicates the oxygen content thereof.

When the engine 1 is operating in closed loop, the air/fuel ratio signal R is used by the computer 21 to centre the engine operation on an air/fuel ratio equal to 1. To this end, the computer 21 firstly computes a control variable of the engine, for example a basic fuel injection duration, with reference to a curve indicating, for a given type of engine and for a given engine speed, the basic injection duration TinjB dependent on a charging parameter of the engine, for example the absolute pressure P of intake air in the pipe 4, this characteristic curve being tantamount to an increasing linear function, in a steady state and across the greatest part of the effective operating range of the engine, defined by an initial shift D in pressure and by a gain G corresponding to the slope of the straight-line curve representing this function. In very high and very low pressure zones, the curve exhibits rounded S-shaped parts obtained from the straight line after multiplicative correction by a map factor K carto, which depends in particular on the engine speed N and the pressure P in the pipe or the opening angle of the valve 5.

For a given speed N of the engine, this linear equation between the basic injection duration TinjB and the intake pressure P, which represents the load or torque required from the engine at a given engine speed, is given by formula (1):

$$TinjB=(P-D)\times G. \quad (1)$$

Applying this injection duration to the injectors, in particular after correction as a function of engine speed, air temperature and a map correction factor to define the injection duration actually applied to the injectors, results in an air/fuel ratio signal R from the [ □] λ sensor which is generally different from 1. The computer 21 increases or reduces TinjB to obtain an air/fuel ratio signal equal to 1. To this end, the computer 21 works out an air/fuel ratio coefficient KO2 by which it multiplies the basic injection duration TinjB given by formula (1) in order to obtain a corrected injection duration TinjCOR in accordance with formula (2): TinjCOR=TinjB×KO2.

In the zones when the engine is operating in open loop, the air/fuel ratio coefficient KO2 is selected so as to be equal to 1. These zones specifically correspond to operation during which the λ sensor is faulty or at an air temperature below a threshold at which closed loop is actuated, for example when cold-starting the engine, or if the open loop is imposed by the engine speed or the opening angle of the valve, for example during deceleration or at full load, or if the engine speed N is higher than a given high threshold, for example 4500 rpm and, generally speaking, whenever the air/fuel ratio sought differs from 1.

After correction by multiplying by air/fuel ratio coefficient KO2, the value of the shift D or the gain G is modified by a cyclical automatic adaptation so that any variances in this air/fuel ratio coefficient KO2 are corrected to ensure that it remains close to 1. In this example, KO2 is deemed to be a multiplication correction factor of a mean value equal to 1.

This automatic adaptation is performed in the manner that will now be described with reference to FIGS. 2 and 3.

Figure 2:
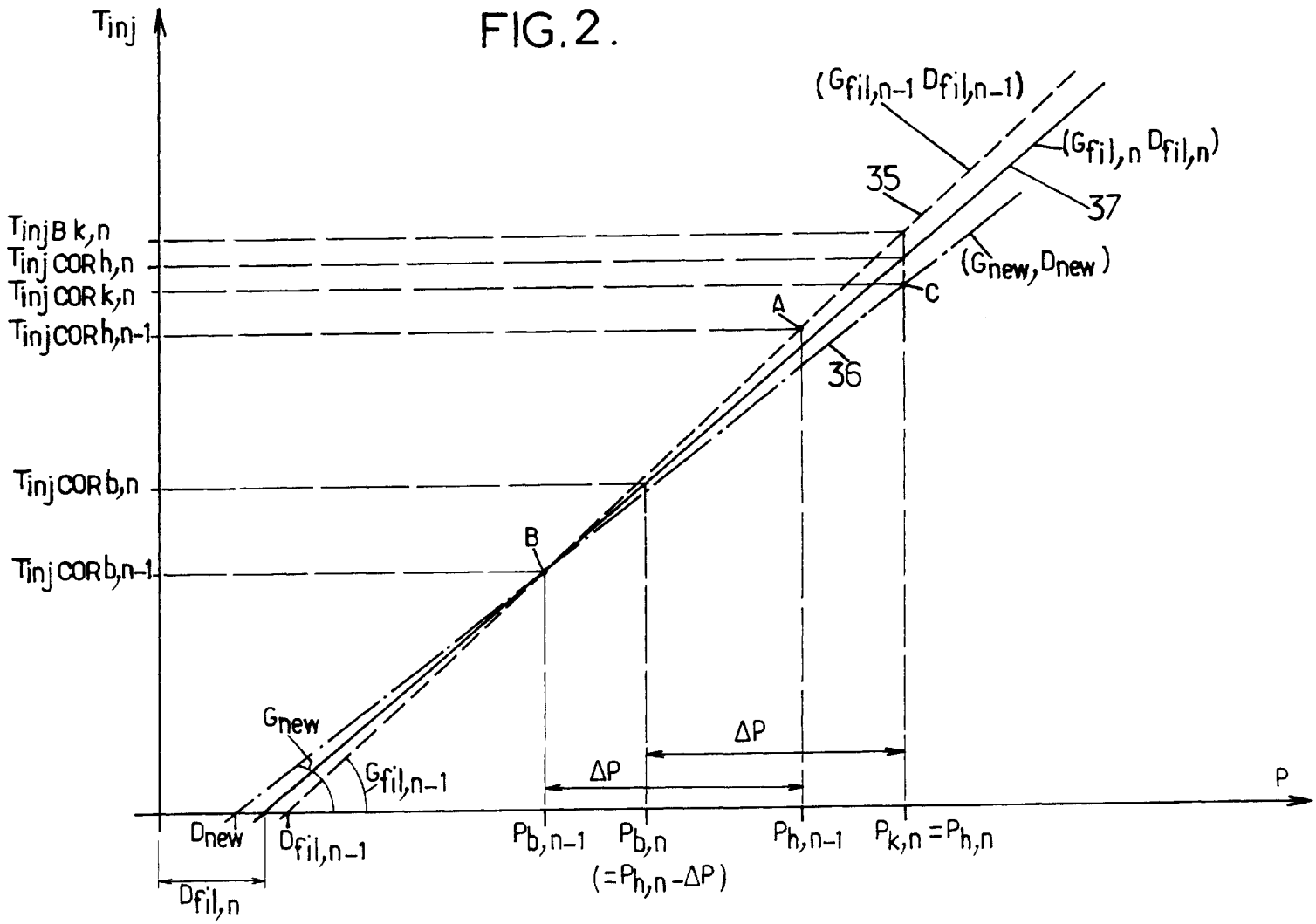
FIG. 2 shows curves expressing the injection duration, giving an example of the engine control variable as a function of the absolute pressure in the intake pipe and giving an example of the charging parameter of the engine.

In a steady state, the memory of the computer 21 contains the following data, stored during the preceding measuring and computing cycle, denoted as order n−1:

- the filtered coefficients, as will be explained below, GFil, n−1 and DFil,n−1 of the preceding filtered operating line of the engine, shown by reference 35 in FIG. 2,
- the pressure values, validated previously, for two operating points of the engine, one of which is at high pressure Ph,n−1 and the other at low pressure Pb,n−1, and separated by a suppressed adaptation band of a constant predetermined width AP of 20 kPa, for example, and the corresponding corrected injection durations TinjCORh,n−1 and TinjCORb,n−1, so that the computer has all the corrected pressure and injection duration coordinates for two points A and B on the preceding filtered operating line 35 (GFil,N−1 and DFil,n−1), as illustrated in FIG. 2,
- information about the adaptation level of the engine in each of the respective pressure ranges above and below the suppressed band ΔP, this information being given by a flag of value 1 or 0 depending on whether the adaptation level of the engine is good or poor, as a function of the measured value of the air/fuel ratio coefficient KO2 relative to a variance threshold on its mean value 1, as will be explained below,
- parameters for an initialisation state, described below, and applied whenever the engine is started.

The computer also has in memory a certain number of parameters and coefficients which might assume one or more constant values as stipulated below.

A new measuring and computing cycle for automatic adaptation of order n commences with a search for and acquisition of an operating point of the engine in a stabilized state, outside the suppressed adaptation band ΔP.

On the basis of each power modification required (translated by a variation in at least the pressure Pk of the air admitted to the engine or the position of the valve 5 for the intake air), above a specific defined threshold, the computer continuously compares the pressure Pk in the intake pipe 4 with a filtered value PkFil of this pressure in order to eliminate slight pressure fluctuations by a first order filtering process, known per se, and with a phase shift delayed by one cycle, in accordance with the formula:

$$PkFil,n=PkFil,n-1+k(Pk,n-PkFil,n-1),$$

where k is a factor between 0 and 1 and PkFil,n−1 was stored in the computer during the preceding cycle n−1.

When the valve 5 opening and the engine speed N are substantially constant, as soon as the difference between the measured pressure Pk,n and the measured and filtered pressure PkFil,n falls below a given threshold S1, of a low value, once a given number of transitions of KO2 around its mean value 1 has been detected, the engine is considered as stabilized.

If, in addition, the measured pressure Pk,n or the filtered pressure PkFil,n, which is not very different from it, is outside the suppressed adaptation band, corresponding to the pressure band of width ΔP positioned during the preceding cycle n−1 and stored in the computer, the new cycle of order n for measuring and computing coefficients for the new filtered operating line (DFil,n and GFil,n) is initiated. The values of the intake pressure Pk,n, its filtered value PkFil,n and a corresponding mean or filtered value KO2Fil,n of KO2 are entered and stored in the computer with:

KO2Fil,n−KO2Fil,n−1+α(KO2,n−KO2Fil,n−1), α being a factor between 0 and 1.

Since the filtered pressure PkFil,n is assumed to be outside the suppressed adaptation band ΔP of the preceding cycle, a new suppressed band of a same width ΔP is positioned so as to be contiguous with the entered pressure Pk,n, which is compared with the lower pressure limit Pb,n−1 of the preceding suppressed adaptation band (Pb,n−1; Ph,n−1).

If Pk,n<Pb,n−1, Pk,n becomes the new lower limit of the new suppressed band: Pb,n=Pk,n and the upper limit then becomes Ph,n=Pb,n+ΔP.

If Pk,n>Pb,n−1, Pk,n becomes the new upper limit of the new suppressed band: Ph,n=Pk,n and the lower limit of said new suppressed band then becomes Pb,n=Ph,n−ΔP.

However, in order to obtain better accuracy in measuring the shift D, a further condition is added to that defined above. This further condition consists in not validating the measured pressure Pk,n as a new bottom pressure Pb,n unless, in addition, Pk,n is less than or equal to a pressure threshold Psb, in the order of 50 kPa for example.

Generally speaking, in a stabilized engine state, the measured pressure Pk,n is not validated as a new top pressure Ph,n unless Pk,n is greater than a pressure band ΔP of predetermined width, corresponding to a suppressed adaptation, and having Pb,n−1 as its lower limit, whereas Pk,n is not validated as a new bottom pressure Pb,n unless Pk,n is below the pressure band ΔP and has Ph,n−1 as its upper limit and if, in addition, Pk,n is less than or equal to said pressure threshold Psb.

If Pk,n is outside the band ΔP and for example is equal to Ph,n because it is above this band Δp as illustrated in FIG. 2, Pk,n corresponds, on the preceding operating line that was stored and filtered (GFil,n−1−DFil,n−1), to a base injection duration TinjBk,n which the computer 21 multiplies by the measured KO2,n or measured and filtered KO2Fil,n air/fuel ratio coefficient in order to obtain a corrected injection duration TinjCORk,n.

Accordingly, a new point C is obtained having coordinates (Pk,n; TinjCORk,n) which replaces one of the two points A and B of known coordinates and stored for computing the stored operating line 35 having coefficients GFil, n−1 and DFil,n−1, the other of the two points A or B being used with the new point C to compute a new operating line 36 having coefficients Gnew, Dnew. If Pk,n=Ph,n (as is the case in FIG. 2), then the third point C replaces point A having coordinates (Ph,n−1; TinjCORh,n−1) so that the new operating line 36 having coefficients Gnew and Dnew can be computed from points B and C, whereas if Pk,n=Pb,n, then point C will replace point B having coordinates (Pb,n−1; TinjCORb,n−1) and the new operating line having coefficients Gnew, Dnew is obtained from points C and A.

In other words, once the filtered pressure PkFil,n of the measured pressure Pk,n is outside the pressure band ΔP positioned during the preceding cycle n−1, the coefficients in memory for the previous operating line 35 GFil,n−1 and DFil,n−1 allow the basic injection duration TinjBk,n corresponding to the value PkFil,n to be computed, and depending on whether Pk,n=Ph,n or =Pb,n, the following is calculated:

$$TinjBh,n=(Ph,n-DFil,n-1)\times GFil,n-1$$

and $$TinjBb,n=(Pb,n-DFil,n-1)\times GFil,n-1.$$

These basic injection durations must be corrected in order to take account of the adaptation quality of the engine, translated by the measured and filtered value of KO2 at the acquisition step so that:

TinjCORh,n=TinjBh,n×KO2Fil,n and

TinjCORb,n=TinjBb,n×KO2Fil,n.

The new operating line 36 is defined using the coordinates of the newly acquired point (Ph,n; TinjCORh,n) or (Pb,n; TinjCORb,n) and those of the last additional point previously acquired in the preceding cycle n−1. In order to simplify the description of this example showing how the invention is implemented, it will be assumed below that the point newly acquired is a high pressure point.

The coefficients of the new operating line 36 are computed using the equations:

$$Gnew=\frac{TinjCORh-TinjCORb}{Ph-Pb}\quad\text{and}$$

$$Dnew=Pb-\frac{TinjCORb}{Gnew}$$

In order to avoid too rapid variations in the coefficients of the engine operating line during an automatic adaptation, the new operating line 37 of order n now stored is a new operating line which is filtered, being defined by new filtered coefficients DFil,n and GFil,n and which is an intermediate line 37 between the stored line 35 of order n−1 and having coefficients DFil,n−1 and GFil,n−1 and the new line 36 defined by the new computed coefficients Dnew and Gnew. To this end, it is of particular advantage to find the coefficients of the new filtered operating line 37 by applying a logical filter to the new computed coefficients Dnew and Gnew, which consists in taking account of only a fraction of the variance found between each of the new computed coefficients Gnew and Dnew and the preceding filtered coefficients GFil,n−1 and DFil,n. The new coefficients GFil,n and DFil,n are thus obtained, which are applied and stored, using adaptation correction factors KD and KG, ranging between 0 and 1, which may be different from one another or the same, and such that the new filtered coefficients are obtained by the following equations:

$$DFil,n=DFil,n-1+KD(Dnew-DFil,n-1)$$

and $$GFil,n=GFil,n-1+KG(Gnew-GFil,n-1).$$

The new filtered coefficients GFil,n and DFil,n are then stored and substituted for the preceding filtered coefficients GFil,n−1 and DFil,n−1 in order to determine the next operating line during the next automatic adaptation cycle of order n+1. Consequently, the engine will then operate on the line (GFil,n; DFil,n) until a new measuring cycle occurs, starting with a new measurement of Pk and its possible validation, which defines a new line. The different lines so defined form a dynamic cloud around a mean line.

As far as the adaptation correction factors KD and KG are concerned, the factors are applied at several levels, depending on the regulation rate of the engine, translated by the value of the air/fuel ratio coefficient KO2. The level of the factors KD and KG is selected as a function of the value of KO2 found in each of the high and low pressure ranges, which are respectively above and below the corresponding suppressed adaptation band ΔP, in the manner described below.

In particular, the method may consist in selecting, for each of the two factors KD and KG, three different values, which will be a high value, for example 0.5, a mean value, for example 0.1, and a low value, for example 0.05, depending on the value of the air/fuel ratio coefficient KO2 measured in the high and low pressure ranges on either side of this suppressed pressure range.

These three separate values for the adaptation correction factors KD and KG or the factor K if KD=KG=K, are useful because they allow the adaptation speed to be optimized as a function of the level of the engine adaptation found in the two adaptation ranges (high pressure range and low pressure range) and represented by a flag Fb or Fh associated respectively with the low pressure range or the high pressure range. The high, mean and low values of the factors KG and KD therefore correspond to a rapid, mean or slow adaptation respectively and are chosen depending on whether the measured and filtered air/fuel ratio coefficient KO2Fil exhibits a variance greater or less than a given threshold variance of 3.5% for example, with respect to its mean value 1, in one and/or the other of the two high and low pressure ranges. When acquiring a low pressure point Pb or a high pressure point Ph respectively, the flag Fb or Fh associated respectively with the low pressure range or the high pressure range is assigned a value which depends on the degree of adaptation of the engine and is set at 0 if the engine is not very well adapted and 1 if the engine is in the adaptation range defined by said variance threshold on the mean value of KO2 so that:

if Pk=Pb and KO2Fil is between 0.965 and 1.035 (i.e. 1±0.035), then Fb=1, if Pk=Pb and KO2Fil<0.965 or KO2Fil>1.035, then Fb=0, if Pk=Ph and KO2Fil is between 0.965 and 1.035, then Fh=1 and if Pk=Ph and KO2Fil<0.965 or KO2Fil>1.035, then Fh=0.

The table (given at the end of the description) gives two examples of high, mean and low values for the factors KD and KG as a function of the values of the flags Fb and Fh, which in turn depend on the values of KO2 in the high and low pressure ranges, the values for KD and KG optionally being different as in example I and of equal value for K=KD=KG as in example II.

The value of Fb or respectively of Fh is updated and stored along with the corresponding value of KO2Fil with every pressure measurement PkFil that is validated.

Whenever the engine is started up, the memory of the computer 21 contains a filtered operating line having coefficients DFil and GFil stored at the end of the last adaptation cycle run before the engine was switched off. This line having coefficients DFil and GFil is used to determine theoretical corrected injection durations TinjCORh and TinjCORb corresponding to two selected intake pressures selected from outside the usual pressure range and which are respectively an initialisation high pressure PhINIT, in the order of 90 kPa for example, and an initialisation low pressure PbINIT, in the order of 30 kPa for example. A suppressed adaptation band ΔpINIT is also selected, essentially centred between PbINIT and PhINIT, and having a lower limit corresponding for example to the low pressure threshold Psb, for example 50 kPa, and a width ΔpINIT of 20 kPa for example, which gives an upper limit or threshold high pressure of 70 kPa for this example. On re-starting, it also be assumed that KO2Fil=1.

The measuring and computing cycle then runs as for the steady state, a new pressure point Pk being acquired and validated if it is outside the suppressed band ΔpINIT, and the coefficients DFil,n and GFil,n computed for the new filtered operating line using the new measured and filtered pressure PkFil,n and one of the two initialisation pressure points PhINIT or PbINIT. Furthermore, when the engine is re-started, the computer 21 is progressively adapted to the real conditions by setting the initial values for the adaptation correction factors KD and KG depending on a fictitious degree of adaptation of the engine. Let us assume, for example, that the engine is well adapted on start-up, in which case the flags Fb and Fh are equal to 1 and KG and KD are 0.05 as in the previous example.

When the computer 21 is manufactured or before it is initially brought into operation, the memory of the computer 21 is pre-loaded with initial values GINIT and DINIT for the coefficients of the operating line, which will have been defined experimentally specifically for the type of engine. The first time the computer 21 is switched on, GFil and DFil are initialized at the calibration values GINIT and DINIT. These calibration values are thus substituted for the coefficients GFil and DFil the first time the engine is started up. The method then runs as described above after being restarted.

In order to improve the co-existence of the automatic adaptation strategy described above with the strategy for purging the canister 16, this purging taking place in particular when the computer 21 issues a command to open the valve 20 when the intake pressure points are within the suppressed adaptation band during engine operation, priority is assigned to the different strategies depending on the adaptation level of the engine and the degree to which the canister 16 is filled with fuel vapor. A system of assessing a coefficient KCAN indicating the fuel content of the canister 16 and its purging circuit is known from EP-A-0 636 778 and FR-A-2 708 049 in particular, whereby this coefficient KCAN is computed when a purging operation is permitted (valve 20 has been opened by the computer 21) based on the drift in the air/fuel ratio coefficient KO2 so that KCAN is increased if KO2 is below its mean value and KCAN is decreased if KO2 is above its mean value. If the canister is very full, KCAN is higher than a predetermined threshold for fuel content and, in accordance with the method proposed by the invention, adaptation will then be suppressed. If, on the other hand, KCAN falls below said fuel content threshold, the computer 21 will permit initiation of the automatic adaptation phase, which suppresses the flow through the purging valve 20 simultaneously with the automatic adaptation.

If the engine is not being sufficiently adapted within the high or low pressure range, i.e. if Fh or Fb is equal to 0, adaptation will take priority in the pressure range in question. If, on the other hand, adaptation is sufficient (Fh or Fb=1), priority for the time being can be given to purging within the pressure range where adaptation is good in addition to the exclusivity assigned to purging in the suppressed adaptation band. Priority is managed by modulating the width of the suppressed adaptation band. In effect, within this band, adaptation is suppressed and, as mentioned above, it is natural to dedicate this band entirely to purging. The wider this band is, the higher the priority assigned to purging. The method of the invention therefore proposes modulating the width of this suppressed adaptation band relative to a nominal value in order to manage priority between purging and adaptation. To this end, the suppressed adaptation band, which is of a nominal width ΔPINIT, is widened by a margin referred to as a top margin towards the high pressures and/or is widened by another margin, referred to as the bottom margin, towards the low pressures if the regulation rate of the engine is satisfactory in the high pressure range (Fh=1) and/or in the low pressure range (Fb=1), as a function of the value of the air/fuel ratio coefficient KO2 in the high pressure range and/or in the low pressure range, which are respectively above and below the suppressed adaptation band of a nominal width ΔPINIT, before being widened by one and/or the other margin.

By way of example, if ΔPINIT=20 kPa and each of the top and bottom margins is set at a calibration value of 10 kPa if Fh or Fb=1, or is equal to 0 if Fh or Fb=0, then the suppressed automatic adaptation band may assume three separate values which are 20 kPa if the two margins are zero, 30 kPa if a single margin is added to ΔPINIT or 40 kPa if ΔPINIT is widened by the two margins. This band, which may be more or less wide, is entirely dedicated to purging and the purging operation therefore assumes a higher or lower priority depending on the width of this band. During the initialisation phase once the engine has been switched on, the margins are zero and the suppressed adaptation band is limited to the value of ΔPNIT so that adaptation takes priority. However, the limitation of Pb to the maximum value for the bottom pressure Psb continues to be applied.

Widening the suppressed adaptation band on the side or the sides at which the engine is well adapted in fact procures a gain in time so that the purging operation can be run. However, so as not to penalize the adaptation process, this widening of the suppressed adaptation band will only be effective during a predetermined period of time, for example three minutes, which is counted back by means of a counter actuated with each automatic adaptation cycle so that the adaptation options can be brought back into play at the end of this predetermined period of time.

Figure 3:
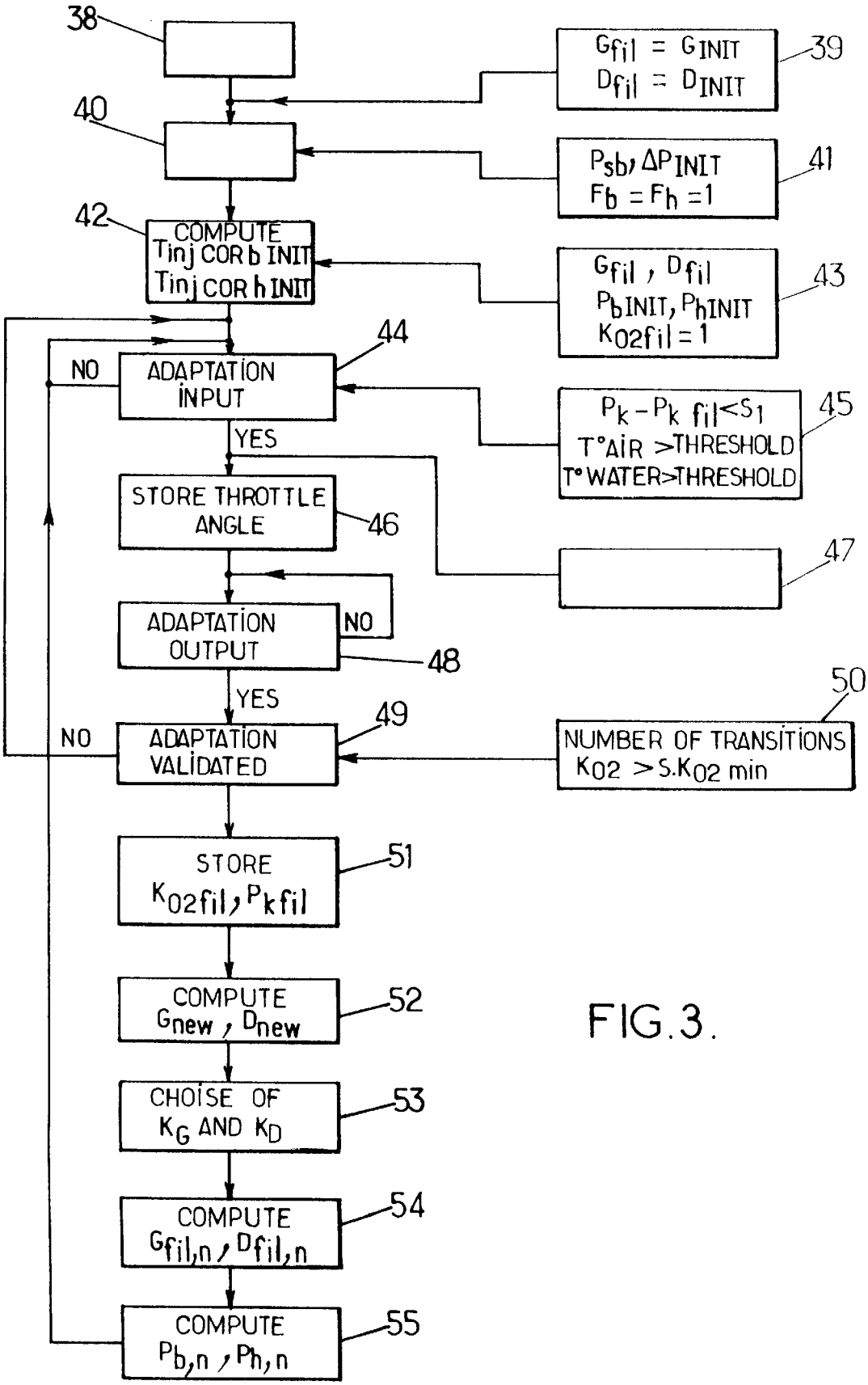
FIG. 3 is a schematic flow chart of the automatic adaptation system.

The flow chart of the adaptation described above and implemented by the computer 21, which comprises at least one programmed microprocessor and/or is configured to control the process outlined above, is schematically illustrated in FIG. 3.

In FIG. 3, the step at which voltage 38 is applied implies that, if this is the first time the computer 21 has been switched on, the initialisation values GINIT and DINIT will be taken into account for the coefficients GFil and DFil of the operating line stored during the first initialisation at 39. The next step 40 is the step at which the adaptation ranges on either side of the suppressed adaptation band are defined on the basis of the nominal and initial value ΔPINIT, the maximum bottom pressure threshold Psb and flags indicating the adaptation of the engine Fb and Fh, selected to as to be equal to 1 at step 41. The next step 42 consists in computing the theoretical and initial values of TinjCORb and TinjCORh from the values of GFil, DFil, PbINIT and PhINIT and for KO2Fil=1, which are recorded at 43. The next step 44 consists in verifying the conditions for initiating adaptation. Adaptation is initiated if the current pressure in the pipe Pk is within one of the permitted adaptation ranges and if the engine stability is verified, i.e. if the engine is operating in a stabilized mode in which Pk−PkFil<S1 (pressure threshold) and if the air temperature on the one hand and the engine coolant liquid (generally water) temperature on the other are above respective thresholds, as indicated at 45. As adaptation is initiated, the angle of the throttle valve 5 will be stored at 46. In parallel, a command to suppress purging is transmitted at 47, optionally in conjunction with commands to suppress operation of a valve for recycling the exhaust gases and/or any other accessory whose operation drives a modification of the air/fuel ratio. At the next step 48, adaptation is abandoned if at least one of the conditions prompting initiation of the adaptation at 44 is no longer verified or if the variation in the angle of the throttle valve 5 relative to the angle stored at 46 is higher than a threshold or alternatively if the number of transitions of the signal KO2 from the onset of adaptation at 44 is higher than a threshold SKO2max. At the next step 49, the adaptation is validated if the number of transitions of the signal KO2 since the onset of adaptation at 44 is higher than a minimum threshold SKO2min, as indicated at 50. The minimum and maximum threshold conditions SKO2min and SKO2max for the transitions of KO2 limit the time spent on adaptation whilst guaranteeing an effective stability of the acquisitions needed for the computations, the stabilization of KO2,Fil being indicative of the drift of the air/fuel ratio and stabilization of the filtered pressure PkFil being representative of the engine load. If the adaptation is not validated, the system will return to step 44 at which adaptation is initiated whereas if the adaptation is validated, the process moves on to 51, where the signals KO2Fil and PkFil are stored, after which the coefficients Gnew and Dnew are computed at 52 in the manner described above, followed by the selection of adaptation correction factors KG and KD at 53, also as described above and, at 54, computation of the coefficients for the new stored operating line GFil,n; DFil,n and finally, at 55, computation of the pressure limits Pb,n and Ph,n defining the suppressed adaptation band stored for the next cycle.

| | KO2Fil | | | | | Ex. 2 |
|---|---|---|---|---|---|---|
| | High pressure | Low pressure | | Ex. 1 | | KD = K |
| Fb | range | range | Fn | KD | KG | KG = K |
| 1 | 0.965 < KO2 < 1.035 | 0.965 < KO2 < 1,035 | 1 | 0.05 | 0.05 | 0.05 |
| 1 | 0.965 < KO2 < 1.035 | KO2 < 0.965 or 1.035 < KO2 | 0 | 0.05 | 0.10 | 0.10 |
| 0 | KO2 < 0.965 | 0.965 < KO2 < 1.035 Or 1.035 < KO2 | 1 | 0.10 | 0.05 | 0.10 |
| 0 | KO2 < 0.965 Or 1.035 < KO2 | KO2 < 0.965 Or 1.035 < KO2 | 0 | 0.50 | 0.50 | 0.50 |

What is claimed is:

1. A method of automatically adapting the air/fuel ratio of an injection engine (1) by means of a computer (21) which, on the one hand, is connected at least to sensors (26, 28) monitoring operating parameters of the engine (1), from which the computer receives at least one engine speed signal (30) and a signal (27) enabling an engine charging parameter (P) to be determined, and to an oxygen sensor (33) in the exhaust gas of the engine (1), from which the computer receives an air/fuel ratio signal (R), and, on the other hand, computes at least values for at least one control variable to be transmitted to at least one injector (2) which are obtained from basic values for the control variable (TinjB) expressed as increasing linear functions of the charging parameter (P) and represented by straight-line curves, each defined by two coefficients, these being a shift (D) from the initial charging parameter and a gain (G) indicating the slope of the line such that TinjB=(P−D)×G, each basic value of the control variable (TinjB) being corrected to generate a corrected value for said control variable (TinjCOR) taking account of an air/fuel ratio coefficient (KO2), to which value transitions are applied as a function of the air/fuel ratio signal (R) in the operating zones of the engine (1) in closed loop, and fixed at a mean value in the operating zones of the engine (1) in open loop in order to ensure that operation of the engine (1) is centered on an air/fuel ratio (R) equal to 1, the shift (D) and the gain (G) also being automatically adapted in cycles to ensure that the air/fuel ratio coefficient (KO2) remains close to its mean value by correction of any shift in this coefficient (KO2) by taking account of top and bottom values (Ph and Pb) of the charging parameter for operating points of the engine (1) in a stabilized state, characterized in that it comprises steps which, for each new cycle of automatic adaptation of the order n, consist in defining a new characteristic line for the control variable (Tinj) as a function of the charging parameter (P) on the basis of new coefficients (Dnew) and (Gnew), computed from the charging parameter and control variable coordinates at two points, one of which is at a top value (Ph) and the other at a bottom value (Pb) of the charging parameter, and to which corrected values for the control variable (TinjCORh and TinjCORb) correspond, by applying the formulas:

$$Gnew = \frac{TinjCORh - TinjCORb}{Ph - Pb} \text{ and}$$

$$Dnew = Pb - \frac{TinjCORb}{Gnew}, \text{ and}$$

validating a value (Pk,n), measured when the engine (1) is in a steady state, as a top value (Ph,n) or respectively as a bottom value (Pb,n) for the charging parameter, correlating to it a basic value respectively for the top or bottom control variable in the order n (TinjBk,n) taken from an operating line filtered and stored in the computer during the preceding cycle n−1 and defined by stored coefficients (DFil,n−1 and GFil,n−1), and then correlating it to a corrected value for the control variable (TinjCORk,n) in order to obtain a first point, and taking as the second point respectively the point having the top or bottom value for the charging parameter from the two points stored in the computer during the preceding cycle n−1, and having coordinates (Pb,n−1, TinjCORb,n−1; Ph,n−1, TinjCORh,n−1), and then adopting as the new filtered operating line, defined by new filtered coefficients (DFil,n and GFil,n), an intermediate line between the stored line having coefficients (DFil,n−1 and GFil,n−1) and the new line defined by the newly computed coefficients (Dnew and Gnew), and storing the new filtered coefficients (GFil,n and DFil,n) and substituting them for the preceding filtered coefficients (GFil,n−1 and DFil,n−1) to determine the next operating line for the next automatic adaptation cycle.

2. A method of automatic adaptation as claimed in claim 1, characterized in that when the engine is running at a stabilized speed, it also consists in validating the measured value of the charging parameter (Pk,n) as the new top (Ph,n) or bottom (Pb.n) value respectively only if (Pk,n) is respectively above a suppressed adaptation band of a predetermined width and having (Pb,n−1) as a lower limit, or respectively below said suppressed adaptation band and having (Ph,n−1) as an upper limit.

3. A method of automatic adaptation as claimed in claim 2, characterized in that, with each new cycle of automatic adaptation of order n, it consists in making a new suppressed adaptation band contiguous with the value entered for the charging parameter (Pk,n) and comparing this latter value with the lower limit (Pb,n−1) of the previous suppressed adaptation band so that if (Pk,n) is lower than (Pb,n−1), (Pk,n) will then become the new lower limit (Pb,n) and the new upper limit will become: Ph,n=Pk,n+ΔP, ΔP being the width of the suppressed adaptation band, and if (Pk,n) is higher than (Pb,n−1), (Pk,n) will then become the new upper limit (Ph,n) and the new lower limit becomes: Pb,n=Pk,n−ΔP.

4. A method of automatic adaptation as claimed in claim 2 characterized in that it additionally consists in validating the measured value of the charging parameter (Pk,n) as a new bottom value (Pb,n) only if, in addition, (Pk,n) is below or equal to a value threshold of the charging parameter.

5. A method of automatic adaptation as claimed in claim 2 characterized in that it consists in deeming the engine speed to have stabilized if, after a predetermined number of transitions in the air/fuel ratio coefficient (KO2) around its mean value have been found and if the engine speed (N) and the position of a throttle member controlling the air supply rate to the engine are substantially constant, the difference between the measured value of the charging parameter (Pk,n) and a measured and filtered value of this parameter (PkFil,n) is below a value threshold, in which $$PkFil,n = PkFil,n-1 + k(Pk,n - PkFil,n-1),$$

and where k is a factor between 0 and 1.

6. A method of automatic adaptation as claimed in claim 5, characterized in that a cycle of measuring and computing coefficients for the new filtered operating line (DFil,n and GFil,n) is initiated if the measured and filtered value (PKFil, n) of the charging parameter is outside the suppressed adaptation band located in the preceding cycle n−1.

7. A method of automatic adaptation as claimed in claim 2 characterized in that it consists in defining the new filtered operating line, having coefficients DFil,n and GFil,n, by applying a logical filtering process to the new computed coefficients Dnew and Gnew which consists in taking into account only a fraction of the difference between Dnew and Gnew respectively and the preceding filtered coefficients DFil,n−1 and GFil,n−1 respectively using an approximation of the first order, on the basis of adaptation correction factors KD and KG, which range between 0 and 1 and may be equal, such that:

$$DFil,n=DFil,n-1+KD(\text{Dnew}-DFil,n-1)$$

and $$GFil,n=GFil,n-1+KG(\text{Gnew}-GFil,n-1).$$

8. A method of automatic adaptation as claimed in claim 7, characterized in that it consists in applying adaptation correction factors KD and KG at several levels, depending on the control rate of the engine (1) translated by the value of the air/fuel ratio coefficient (KO2).

9. A method of automatic adaptation as claimed in claim 8 characterized in that it consists in choosing the level of the factors KD and KG depending on the value of KO2 as ascertained in each of the ranges of the top and bottom values of the charging parameter respectively above and below the corresponding suppressed adaptation band.

10. A method of automatic adaptation as claimed in claim 9, characterized in that it consists in choosing a strong, mean or weak value respectively for at least one of the factors KD and KG depending on whether the air/fuel ratio coefficient KO2 is measured outside a band of the air/fuel ratio coefficient centred on the mean value of KO2 and of predetermined width, in the two charging parameter ranges which are above and below said suppressed adaptation band, or measured outside said air/fuel ratio coefficient band in one of said charging parameter ranges above or below said suppressed adaptation band but inside said air/fuel ratio coefficient band in the other of said upper and lower charging parameter ranges or, finally, measured inside said air/fuel ratio coefficient band in the two upper and lower charging parameter ranges.

11. A method of automatic adaptation as claimed in claim 7 characterized in that, every time the engine (1) is started, it consists in determining, by means of the filtered operating line, having coefficients (DFil) and (Gfil), stored in memory on re-starting, two theoretical values for the control variable (TinjCORh) and (TinjCORb) corresponding to two values of the charging parameter selected from outside the usual range of values for said charging parameter and which are a top initialisation value PhINIT and a bottom initialization value PbINIT respectively, selecting a suppressed adaptation band essentially centred between PbINIT and PhINIT, with a lower limit (Psb) higher than PbINIT and an upper limit (Ph) lower than PhINIT, after which the measuring and computing cycle is then run as in the continuous state, a new validated value being acquired for the charging parameter if said new value falls outside the suppressed adaptation band and the coefficients (DFil,n and GFil,n) for the new filtered operating line being computed on the basis of the new measured and filtered value of the charging parameter (PkFil) and one of the two initialisation value points (PhINIT or PbINIT) of said parameter.

12. A method of automatic adaptation as claimed in claim 11 characterized in that when the engine is re-started, it consists in progressively adapting the computer (21) to the real conditions by setting the initial values for the adaptation correction factors KD and KG as a function of a fictitious degree of adaptation of the engine.

13. A method of automatic adaptation as claimed in claim 11 characterized in that, before the computer (21) is switched on for the first time, it consists in pre-loading initial values (GINIT and DINIT) of the operating line coefficients into the computer memory, which are defined experimentally for the specific type of engine, and substituting them for the coefficients (GFil and DFil) stored for start-up purposes and not yet existing.

14. A method of automatic adaptation as claimed in claim 2, for an engine (1) co-operating with a purging circuit, fitted with a canister (16) to collect fuel vapors from at least one tank (11) and connected to an intake pipe (4) of the engine (1) by an electrically controlled purging valve (20) of the canister (16), and whose rate is driven by the computer (21) so that the timing of the purging valve (20) simultaneously with the automatic adaptation is inhibited, characterized in that it also consists in widening the suppressed adaptation band respectively towards the top values or towards the bottom values of the charging parameter if the engine regulation rate is satisfactory, depending on the value of air/fuel ratio coefficient (KO2), within the respective top or bottom range of the charging parameter which is above or below said suppressed adaptation band respectively before it is widened.

15. A method of automatic adaptation as claimed in claim 14, characterized in that it also consists in not widening the effective suppressed adaptation band except during a predetermined period of time, assisted by a counter which is re-started with each automatic adaptation cycle to count down said period of time.

16. A method of automatic adaptation as claimed in claim 14 characterized in that it also consists in defining an estimated coefficient (KCAN) of the fuel contents in the purging circuit, computing this coefficient (KCAN) when purging is permitted on the basis of the deviation in the air/fuel ratio coefficient (KO2) so that KCAN is increased or decreased respectively if KO2 is respectively below or above its mean value and in that it further consists in entering an automatic adaptation phase if KCAN falls below a predetermined threshold relating to the fuel content.

17. A method of automatic adaptation as claimed in claim 1 characterized in that it also consists in converting the base value (TinjB) into a corrected value of the control variable (TinjCOR) by a multiplicative correction using the air/fuel ratio coefficient (KO2) such that: TinjCOR=TinjB×KO2.

18. A device for automatically adapting the air/fuel ratio of an injection engine (1), comprising:

a computer (21) connected to sensors (26, 28) detecting operating parameters of the engine (1) as well as an oxygen sensor (33) in the exhaust gas of the engine (1), said computer (21) computing values of a control variable intended to be applied to at least one fuel injector (2) of the engine (1), and obtained from base values (TinjB) expressed as increasing linear functions of a charging parameter, with a shift (D) from the original charging parameter and a gain (G) corresponding to the slope of the corresponding characteristic line, said base values of the control variable (TinjB) being corrected by means of a air/fuel ratio coefficient (KO2) determined by the computer (21) as a function of the air/fuel ratio signal (R) from the oxygen sensor (33) in closed loop operation and equal to a mean value in open loop operation, in order to center operation of the engine (1) on an air/fuel ratio equal to 1, the computer (21) automatically adapting the shift (D) and the gain (G) in cycles to ensure that KO2 remains close to its mean value by correcting any deviation in KO2, and said computer (21) comprising at least one microprocessor programmed for performing calculations and manipulating values necessary for automatically adapting the air/fuel ratio.

* * * * *